United States Patent [19]

Fujihara

[11] 4,411,192

[45] Oct. 25, 1983

[54] ROTARY STAMP

[75] Inventor: Naoyuki Fujihara, Konan, Japan

[73] Assignee: Shachihata Industrial Co., Ltd., Aichi, Japan

[21] Appl. No.: 228,745

[22] Filed: Jan. 27, 1981

[30] Foreign Application Priority Data

Feb. 1, 1980 [JP] Japan ..... 55-12254[U]

[51] Int. Cl.[3] ..... B41J 1/60

[52] U.S. Cl. ..... 101/111

[58] Field of Search ..... 101/111, 105

[56] References Cited

U.S. PATENT DOCUMENTS

| | | | |
|---|---|---|---|
| 730,968 | 6/1903 | Reynolds | 101/105 |
| 862,396 | 8/1907 | Heller | 101/111 |
| 3,038,404 | 6/1962 | Thompson | 101/111 |
| 4,033,257 | 7/1977 | Funahashi . | |
| 4,038,918 | 8/1977 | Thompson | 101/111 |

FOREIGN PATENT DOCUMENTS

| | | | |
|---|---|---|---|
| 964926 | 3/1975 | Canada | 101/111 |
| 710447 | 9/1941 | Fed. Rep. of Germany | 101/111 |
| 2823844 | 12/1978 | Fed. Rep. of Germany | 101/111 |

*Primary Examiner*—Richard J. Apley
*Assistant Examiner*—David J. Isabella
*Attorney, Agent, or Firm*—Brumbaugh, Graves, Donohue & Raymond

[57] ABSTRACT

The present invention is a rotary stamp. It comprises a U-shaped frame, a shaft rotatably inserted in the frame, a bridge mounted on the frame, cylinder means fitted on the shaft and operation means for rotating the shaft. An endless belt-like stamping member is mounted around the cylinder means and the bridge. The cylinder means has flanges at both ends having knurls around the circumferences thereof. On the inner side of the frame elastic plates are provided, each plate having on its lower end a pawl to be engaged by one of the knurls on the flanges of the cylinder means.

1 Claim, 5 Drawing Figures

ROTARY STAMP

BACKGROUND OF THE INVENTION

This invention relates to a rotary stamp. More particularly, the present invention relates to a rotary stamp which comprises an inverted U-shaped frame comprising of a top plate and right and left side plates, each having an opening formed substantially at the center and a slit at the lower end thereof; a shaft inserted into the openings; a bridge mounted between the slits; cylinder means rotatably fitted over the outer circumference of the shaft at the portion positioned inside the frame; operation means for rotating the cylinder means; and endless belt-like stamping means mounted around the cylinder means and the bridge, having a number of character portions on the upper surface thereof and made of an elastic material.

A known rotary stamp representing an improvement over the abovementioned rotary stamp comprises an inverted U-shaped frame consisting of a top plate and right and left side plates, each having an opening formed substantially at the center, a further opening below said opening and a slit at the lower end thereof; a shaft inserted into the upper openings, spring means inserted into said lower openings; a bridge mounted between the slits and having a recess at the lower end thereof; cylinder means rotatably fitted over the outer circumference of the shaft at the portion positioned inside the frame; operation means for rotating the cylinder means; an ink-adsorbing member incorporated in said recess; endless belt-like stamping means mounted around the cylinder means and the ink-absorbing member, made of a porous elastic material and having a number of character portions formed on the upper surface thereof; covers for covering the front and back portions of the frame, respectively; and a cap so disposed as to be capable of moving up and down along the side plates of the frame and the outer surfaces at the lower portions of the covers, and having an opening at the lower portion thereof; the spring means normally pushing the cap downwardly so that the surface of one of the character portions is pulled into the cap when said one character portion reaches the lowermost position due to the rotation of the operation means, and allowing the surface of said one character portion to protrude outwardly from the opening of the cap thereby to effect stamping when the cap is pressed down on an article to be stamped against the force of the spring means.

Rotary stamps for stamping the date of the abovementioned kind are disclosed in, for example, U.S. Pat. Nos. 4,033,257 and 4,038,918 (granted to Takaji Funahashi on July 5, 1977 and Aug. 2, 1977, respectively). According to these disclosures, the above-mentioned endless belt-like stamping means consists of a large number of stamping units, and the cylinder means, on which these stamping units are to be mounted individually, are required to be the same in number as that of the stamping units. Furthermore, the same number of operation means are required in order to rotate these numerous cylinder means. In the rotary stamp for stamping the data of this kind, each of the operation means is inevitably composed of a thin disc having gears around its circumference in view of the size of the rotary stamp as a whole. Accordingly, if the endless belt-like stamping means has a large width, the rotational force of the thin discs is likely to insufficient for rotating the stamping means.

In particular, when the endless belt-like stamping means is formed as a unitary structure of a large width, it is impossible to rotate this structure in its entirety by the same amount using one operation means. This results in deformation of the stamping means and hence, deformation of the stamped characters. It is not easy to rotate the endless belt-like stamping means simultaneously by the same amount, even if the operation means are disposed at both end portions of the cylinder means.

SUMMARY OF THE INVENTION

The object of the present invention is to improve upon the rotary stamp of the above-described kind by eliminating the foregoing defects.

To this end, in a rotary stamp comprising an inverted U-shaped frame consisting of a top plate and right and left side plates, each having an opening formed substantially at the center and a slit at the lower end thereof; a shaft rotatably inserted into the openings; a bridge mounted between the slits; cylinder means fitted over the outer circumference of the shaft at the portion positioned inside the frame; operation means for rotating the cylinder means; and endless belt-like stamping means mounted around the cylinder means and the bridge, having a number of character portions on the upper surface thereof and made of an elastic material; the present invention provides a rotary stamp characterized in that the cylinder means is equipped on the outer circumference thereof with a suitable number of equally spaced-apart ridges, and in that the endless belt-like stamping means is equipped on the inner surface thereof with grooves spaced apart to approximately the same degree as the ridges, and mating with respective ones of the ridges.

In accordance with another embodiment of the present invention, in a rotary stamp comprising an inverted U-shaped frame consisting of a top plate and right and left side plates, each having an opening formed substantially at the center, a further opening below the opening and a slit at the lower end thereof; a shaft rotatably inserted into the upper openings; spring means inserted into the lower openings; a bridge mounted between the slits and having a recess at the lower end thereof; cylinder means fitted over the outer circumference of the shaft at the portion positioned inside the frame; operation means for rotating the cylinder means; an ink-absorbing member accommodated in the recess; endless belt-like stamping means mounted around the cylinder means and the ink-absorbing member, made of a porous elastic material and having a number of character portions formed on the upper surface thereof, covers for covering the front and back portions of the frame, respectively; and a cap so disposed as to be capable of moving up and down along the side plates of the frame and the outer surface at the lower portions of the covers, and having an opening at the lower portion thereof; the spring means normally pushing the cap downwardly so that the surface of one of the character portions is pulled into the cap when said one character portion reaches the lowermost position due to the rotation of the operation means, and allowing the surface of said one character portion to protrude outwardly from the opening of the cap thereby to effect stamping when the cap is pressed down on an article to be stamped against the force of said spring means; there is provided a rotary stamp characterized in that the cylinder means is equipped on the outer circumference thereof with a suitable number of axially extending, equally spaced-apart ridges, and in that the stamping means is equipped, on the inner surface thereof, with grooves spaced apart to approximately the same degree as the ridges, and mating with respective ones of the ridges.

These and other objects and advantages of the present invention will become more apparent from the following description of the embodiments thereof to be read in conjunction with the accompanying drawings.

DESCRIPTION OF THE PREFERRED EMBODIMENTS

Figure 1:
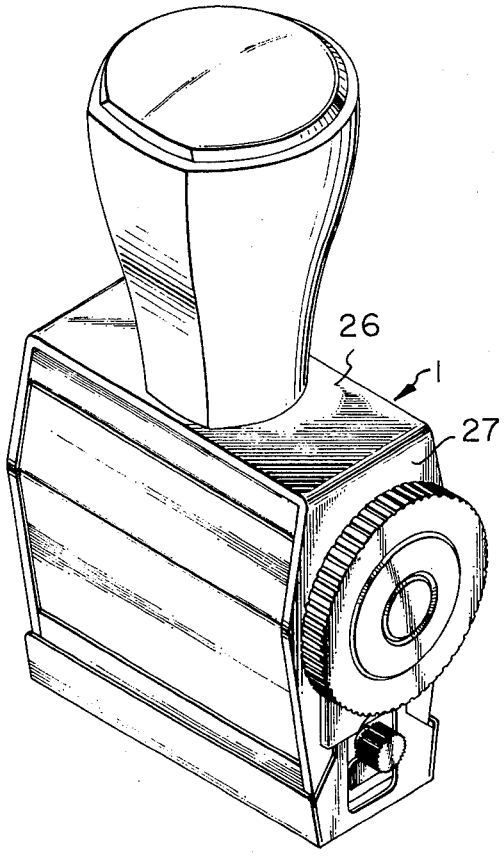
FIG. 1 is a perspective view of the rotary stamp as viewed from the top in accordance with an embodiment of the present invention.
Figure 3:
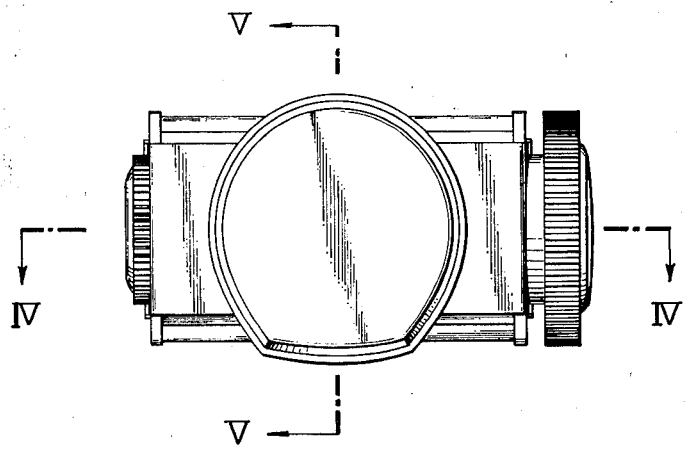
FIG. 3 is a plan view of the rotary stamp.
Figure 2:
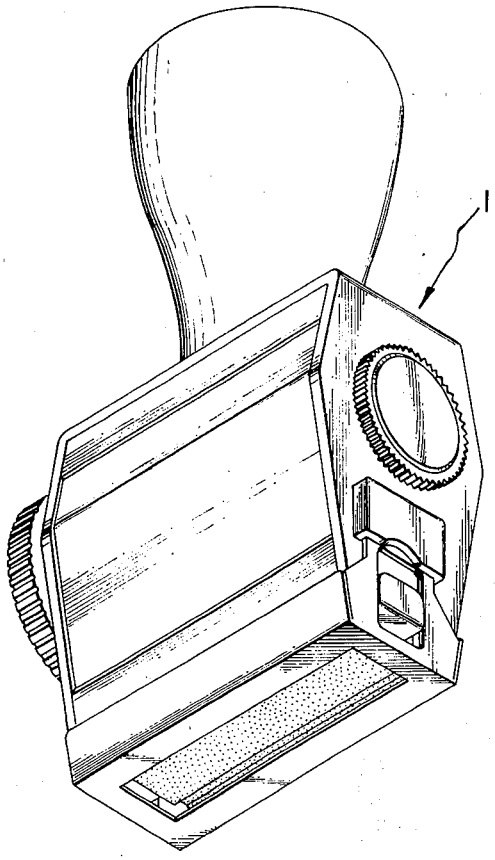
FIG. 2 is a perspective view of the above-mentioned rotary stamp as viewed from the bottom.
Figure 4:
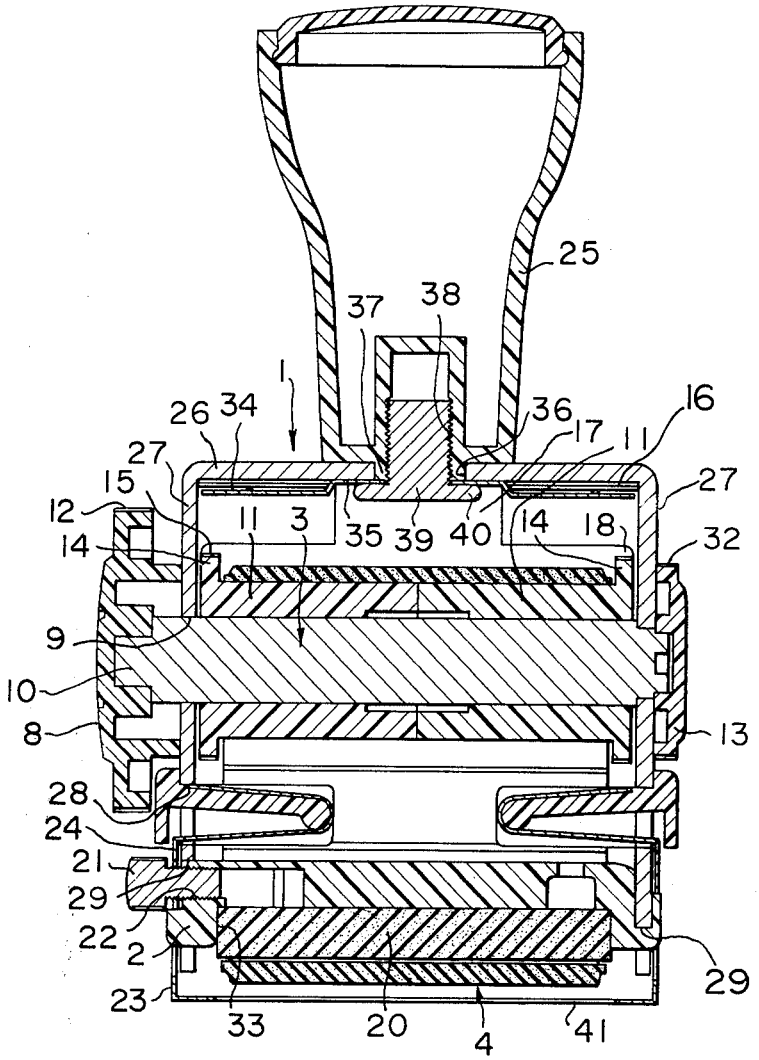
FIG. 4 is a longitudinal sectional view taken along line IV—IV of FIG. 3.
Figure 5:
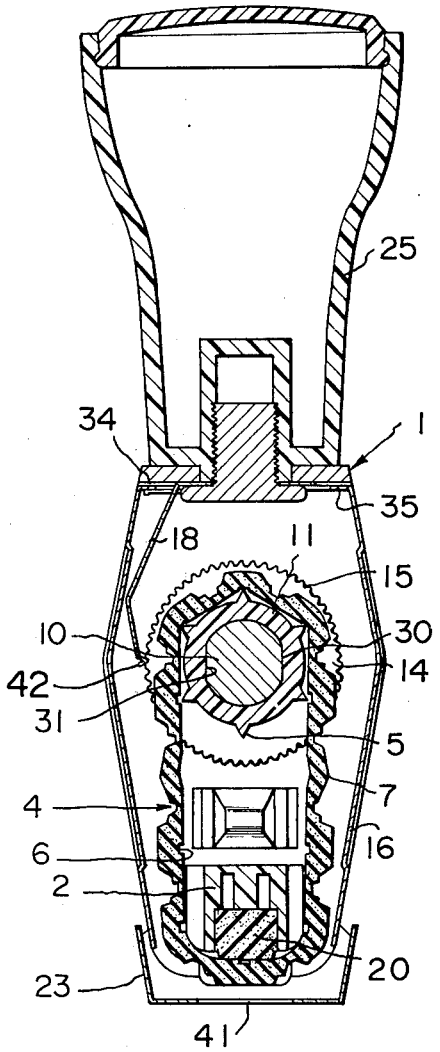
FIG. 5 is a longitudinal sectional view taken along line V—V of FIG. 3.

As shown in the drawings, especially in FIGS. 4 and 5, a frame 1 is made of a inverted U-shaped metal plate consisting of a top plate 26 and right and left side plates 27. Each side plate 27 has a circular opening 9 at the upper portion close to the center of the side plate and a rectangular opening 28 below the circular opening 9.

Each side plate has a recess 19 at its lower end portion, with a bridge 2 mounted between the recesses 29.

A single shaft 10 is rotatably inserted into the circular openings 9 and has axially directed flat surfaces 30 on the portion thereof disposed within the frame 1.

Two cylinders 11 are supported on the outer circumference of the shaft portion having the flat surfaces 30. Accordingly, a rotor 3 is composed of the cylinders and shaft. Rather than two cylinder members 11, the invention also contemplates that a unitary cylinder member may be used.

Both cylinders 11 have, on their inner surface, flat surfaces 31 corresponding to the flat surfaces 30 of the shaft 10, respectively.

Axially extending ridges 5 are provided in an equally spaced-apart relationship on the circumferential surfaces of both cylinders 11, the number of ridges being suitably selected.

Fitted firmly at one end of the shaft 10, which protrudes outwardly beyond the side plate 27 of the frame, is a disc-like operation member 8 having slip-preventing knurls 12 around its outer circumference. Similarly, a substantially disc-like disc member 13 having knurls 32 is fitted firmly to the other end of the shaft 10.

The lower end of the bridge 2 has a recess 33 which accommodates an ink-absorbing member 20.

The bridge 2 further includes a threaded ink-supply port 22 communicating with the exterior of one of the side plates 27 and with the recess 33. A threaded plug 21 is screwed into the ink-supply port 22.

The exterior end portion of each cylinder 11 has a thin flange 14 furnished with knurls 15 around the outer circumference thereof.

Single stamping means 4 having an endless belt-like configuration, porosity and elasticity is mounted around the cylinders 11 and the ink-absorbing member 20, and is provided on its surface with a number of equally spaced-apart character portions 7.

The lateral width of the endless belt-like stamping means 4 substantially corresponds to the distance between the two flanges 14.

The endless belt-like stamping means is provided on its back surface with a number of equally spaced-apart grooves 6 that mate with respective ones of the ridges 5.

The frame 1 is equipped with covers 16 that cover its front and back portions, respectively. The bent portion 34 at the upper end of each cover 16 is placed on the back of the top plate 26 of the frame 1.

A cover-fixing plate 17 of stainless steel material has a bent portion 35 at the upper end that supports the bent portion 34 of each cover 16. Pawls 42 on the lower ends of elastic pawl plates extended from the lower ends on both sides of the cover-fixing plates 17 engage with the knurl 15.

The top plate 26 of the frame 1 has a centrally located opening 36 into which a hollow protruding portion 37 at the lower end of a handle 25 is inserted. The protruding portion 37 has, on its inner surface, a female screw 38, into which a bolt 39 is screwed, the bolt 39 having flange 40 at its lower end. When the bolt is screwed into the protruding portion 37, the bent portion 35 at the upper end of the cover-fixing plate 17 is depressed between the back of the top plate 26 of the frame 1 and the flange 40, thereby attaching the handle 25 to the frame 1 and fixing the covers 16 as well.

A cap 23 having an opening 41 at its lower end portion is so disposed as to be capable of moving up and down along both side plates 27 and along the outer surface at the lower portions of the covers 16.

Each of spring means 24 is inserted into each of the lower rectangular openings 28 to push downwardly on the ends of the cap 23.

In accordance with the present invention, since the grooves 6 formed on the inner surface of the stamping means 4 mate with the corresponding ridges 5 formed on the outer surfaces of the cylinders 11, the stamping means 4 does not undergo deformation even if the means 4 comprises a single body having a large width, and the force required for rotating the stamping means remains sufficient.

The spring means 24 normally pushes the cap 23 downwardly so that one surface of the character portion 7 is pulled into the cap 23 when it reaches the lowermost position due to the rotation of the operation member 8. When the cap 23 is pressed against an article to be stamped, such as paper, against the force of the spring means 24, the surface of one of the character portions 7 protrudes from the opening 41 of the cap thereby to effect stamping when the surface of the character portion reaches the lowermost position.

The endless belt-like stamping means 4 is preferably made of a material such as a porous rubber having numerous continuous holes so that the ink-absorbing member 20 constantly supplies the ink, thus making stamping feasible.

The grooves 6 disposed on the inner surface of the stamping means 4 are aligned with the center line of the character portions 7. Since the character portions 7 having a large thickness is thicker than the portions between the character portions 7, optimal strength can be obtained.

The lateral width of the stamping means 4 corresponds substantially to the distance between the two flanges 14, 14, thereby preventing both side edges of the stamping means 4 from coming into contact with the inner surfaces of both side plates, respectively. Consequently, both side plates remain free from contamination. If the stamping means imcorporates core yarns, the yarns are also prevented from becoming raveled.

While the operation member 8 is rotated, the lower end of the elastic pawl plates 18 is successively engaged with the knurls 15 and then the operation member can be intermittently rotated a small amount.

What is claimed is:

1. In a rotary stamp comprising:

an inverted U-shaped frame comprising a top plate and right and left side plates, each of said side plates having a circular opening formed substantially at the center thereof, a rectangular opening below said circular opening and a recess at the lower end thereof;

a shaft rotatably inserted into said circular openings;

a pair of spring means, each being inserted into a different one of said rectangular openings;

a bridge mounted between said recesses and having a further recess at the lower portion thereof;

cylinder means securely fitted on the outer circumference of said shaft at the portion positioned inside said side plates, said cylinder means having flanges at both ends thereof and being equipped on an outer circumference of portions between said flanges with a number of spaced apart ridges extending the full axial length of said cylinder between said flanges;

operating means for rotating said shaft and directly fitted on the portion of said shaft in the outsides of said side plates;

an ink-absorbed member incorporated in said further recess of said bridge;

an endless belt-like stamping member mounted around said cylinder means and said ink-absorbed member, made of a porous elastic material and having a number of character portions formed on the outer surface thereof, said endless belt-like stamping member being mounted between said flanges on said cylinder means and being equipped on the inner surface thereof with grooves spaced-apart to the same degree as said ridges to mate with respective ones of said ridges, said endless belt-like stamping member being of the same width as a distance between said flanges thus allowing said belt-like stamping member to lay smoothly over said cylinder and wherein said belt-like stamping member is always maintained in alignment by said flanges and said cooperating grooves and ridges;

a pair of covers, for covering the front and back portions of said frame, respectively;

a cap so disposed as to be capable of moving up and down along the outer surfaces of said side plates of said frame and the outer surfaces at the lower portions of said covers;

said spring means normally pushing said cap downwardly so that the surface of one of said character portions is pulled into said cap when one character portion reaches the lowermost position due to the rotation of said operating means, and allowing the surface of said one character portion to protrude outwardly from said opening of said cap thereby to effect stamping when said cap is pressed against an article to be stamped against the force of said spring means;

the improvement wherein said cylinder comprises a unitary element; each of said flanges having knurls around the outer circumference thereof, and said top plate having on a surface thereof downwardly directed elastic plates having on lower ends thereof pawls engaging said knurls on each of said flanges enabling rotation of said cylinder in small increments.

* * * * *